US005361831A

United States Patent [19]

Young

[11] Patent Number: 5,361,831

[45] Date of Patent: Nov. 8, 1994

[54] ROD COUPLING BREAKOUT DEVICE

[75] Inventor: Weldon E. Young, Magnolia, Ark.

[73] Assignee: Atlantic Richfield Company, Los Angeles, Calif.

[21] Appl. No.: 53,123

[22] Filed: Apr. 26, 1993

[51] Int. Cl.[5] ..... E21B 19/16

[52] U.S. Cl. ..... 166/77.5; 166/85

[58] Field of Search ..... 166/77.5, 85, 93, 178, 166/377

[56] References Cited

U.S. PATENT DOCUMENTS

| | | | |
|---|---|---|---|
| 1,861,728 | 6/1932 | Vance et al. | 166/77.5 |
| 2,217,238 | 10/1940 | Sisson | 166/77.5 |
| 2,295,720 | 9/1942 | Dietzmann et al. | 166/77.5 |
| 4.295,526 | 10/1981 | Hauk et al. | 166/71 X |
| 4,458,562 | 7/1984 | Jackson | 166/77.5 X |
| 4,483,564 | 11/1984 | McDaniel | 166/77.5 |
| 5,010,635 | 4/1991 | Clark | 166/85 X |

*Primary Examiner*—Roger J. Schoeppel
*Attorney, Agent, or Firm*—Michael E. Martin

[57] ABSTRACT

Well pump rods and similar threadedly interconnected rod members are loosened from their couplings by a device which includes two opposed housing members which are hinged together and support impact blow transmitting members thereon. A latch mechanism including an over-center or toggle linkage is operable to secure the housing in a closed position encircling a tubular rod coupling with the spaced apart and opposed impact transmitting members adapted to receive impact blows and transmit same to the coupling to loosen the threaded connections between the coupling and the rods. The housing provides a suitable support for transmitting impact blows to the coupling and for retaining the coupling in the event of catastrophic fracture of the coupling.

12 Claims, 1 Drawing Sheet

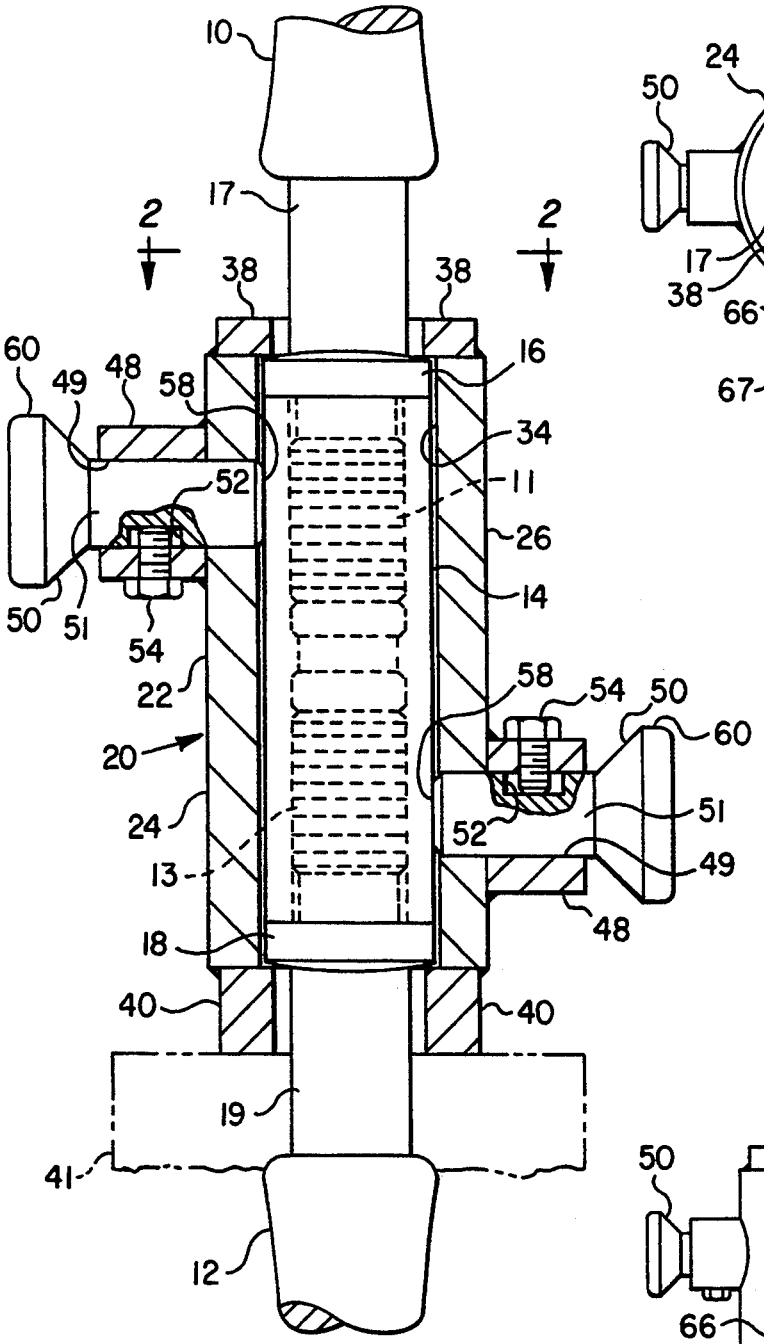
FIG. 1
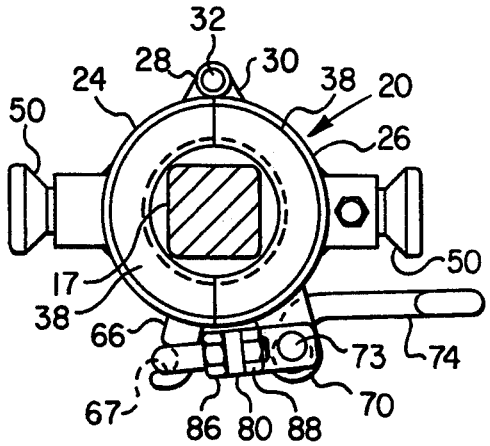
FIG. 2
FIG. 3
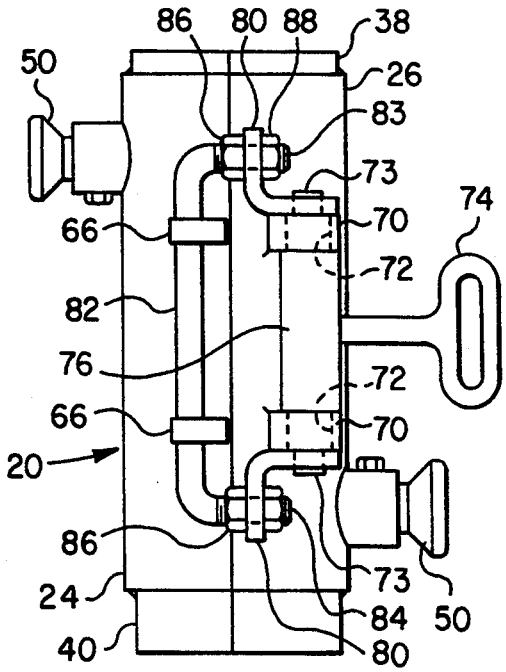

ROD COUPLING BREAKOUT DEVICE

BACKGROUND OF THE INVENTION

1. Field of the Invention

The present invention pertains to an impact type device for delivering impact blow energy to internally threaded couplings for well pump rods and the like to release the threaded connection between the coupling and one or more rods.

2. Background

Oil well pump rods or so-called sucker rods, as well as certain percussion type drill rods, are interconnected end to end by generally cylindrical tubular threaded coupling members. In conducting repair or workover operations in an oil well, the elongated pump rod string or stem must be removed section by section so that certain repair work can be carried out. As each section of rod is raised to a position for removing the rod from the threaded coupling, a wrench is applied to each rod section to loosen the threaded connection between the external threads on the rod end and the internal threads in the coupling. These threaded connections are often very difficult to uncouple due to corrosion, over-tightening and thread deformation due to percussive forces. One technique for loosening the threaded connections between tubular couplings and pump rods is to deliver a series of impact blows to the external surface of the coupling member. This is somewhat difficult to accomplish since the coupling is a cylindrical member and the impact blows often, when delivered by a conventional hammer or the like, result in deflection of the hammer and inefficient transmission of energy, Occasionally, a coupling will fracture, resulting in pieces of the coupling striking objects or persons in the vicinity of the work. Still further, in oil well pump rods it is possible that some volatile fluid has leaked into the interior of the coupling which may aid in effecting bursting of the coupling member.

The above-mentioned problems with decoupling oil well pump rods and similar threadedly connected rods have been overcome with a device in accordance with the present invention wherein impact blows may be more effectively delivered to the coupling in the vicinity of the threaded connection between the coupling and the rod member and wherein a housing encircles or encloses the coupling to contain the coupling in the event of catastrophic failure thereof.

SUMMARY OF THE INVENTION

The present invention provides a unique device useful for breaking loose the threaded connections between tubular couplings and oil well pump rods and similar types of couplings between end to end connected rod members.

In accordance with an important aspect of the present invention, there is provided a rod coupling "breakout" device comprising a generally cylindrical housing which is hinged so that it may be placed around a tubular coupling between oil well pump rods and similar threadedly interconnected rod members, which housing has supported thereon opposed impact blow delivering members which are adapted to transmit impact blows to the coupling in the vicinity of the threaded connection between the coupling and the rod member to loosen the threaded connection through impact transmitted vibrations as well as by the generation of heat from the vibrations which will cause differential thermal expansion of the coupling with respect to the rod.

In accordance with another aspect of the present invention, a rod coupling breakout device is provided which includes a housing member which encircles the coupling to substantially contain the coupling in the event of fracture of the coupling during the breakout operation.

In accordance with yet another aspect of the present invention, a well pump rod coupling breakout device is provided which has spaced apart and opposed impact blow transmitting members which are operable to be struck by an impact tool such as a hammer or the like, to transmit impact blows to a rod coupling in such a way that minimum energy is lost in the transmission of the impact blow to the coupling.

In accordance with yet a further aspect of the present invention, there is provided a unique rod coupling breakout device which includes opposed, generally cylindrical housing members which are secured together in a closed position around a coupling by a toggle or over-center mechanism which may be adjusted to modify the closing force between the housing member and which is adapted for quick assembly to and removal from a rod coupling.

The above-noted features and advantages of the present invention, together with other superior aspects thereof, will be further appreciated by those skilled in the art upon reading the detailed description which follows in conjunction with the drawing.

BRIEF DESCRIPTION OF THE DRAWING

FIG. 1 is a central, longitudinal section view of the breakout device encircling a coupling for two interconnected pump rods;

FIG. 2 is a view of the device taken substantially from the line 2—2 of FIG. 1; and FIG. 3 is a front elevation of the coupling breakout device of the present invention.

DESCRIPTION OF A PREFERRED EMBODIMENT

In the description which follows, like parts are marked throughout the specification and drawing with the same reference numerals, respectively. The drawing figures are not necessarily to scale.

Referring to FIG. 1, there is illustrated a threaded connection between two elongated rod members 10 and 12, each of which has external threads formed on a distal end, indicated at 11 and 13, respectively. The rod members 10 and 12 are connected together by a generally tubular internally threaded coupling member 14. The rod members 10 and 12 and the coupling 14 are conventional oil well pump rod and coupling members, respectively, commonly used for mechanically lifting liquids from wells and often known in the art as "sucker" rods. Similar type connections are formed between percussion drill rods and similar coupling members used therewith. The rods 10 and 12 are normally tightly threadedly coupled to the coupling member 14 so that the transverse shoulders 16 and 18 on the respective rod members 10 and 12 abut the transverse ends of the tubular coupling 14. Although the rod members 10 and 12 have generally rectangular cross-section portions 17 and 19, respectively, for applying breakout wrenches thereto, the effort that can be exerted by these wrenches sometimes is insufficient to break loose the threaded connections between the rods 10 and 12 and the internally threaded coupling member 14. Accordingly, it is common in field work to hammer on the coupling 14 to apply heat and vibration thereto to effect loosening of the threaded connections between the rods and the coupling.

The drawing figures illustrate a unique device for more effectively applying impact blows to the coupling 14, which device is generally designated by the numeral 20. The device 20 comprises a housing 22 which is formed of two opposed generally half-cylindrical housing members 24 and 26 which, as shown in FIG. 2, are pivotally connected to each other by suitable hinge means comprising a hinge boss 28 on member 24 and at least one hinge boss 30 on member 26, together with suitable hinge pin means 32 journalled within the respective bosses in a conventional manner. The housing 20 is proportioned such that, when the opposed housing members 24 and 26 are in their closed position, as shown in the drawing Figures, a cavity is formed which loosely journals the coupling 14 as well as the transverse shoulders 16 and 18 of the pump rod members 10 and 12, respectively. In other words, an internal bore portion 34 is formed which is of a diameter only slightly larger than the diameter of the coupling 14. Each housing member 24 and 26 is also provided with opposed half-cylindrical retaining collar parts 38 and 40 which are suitably secured to the housing members 24 and 26 by welding, for example. The internal diameters of the collar parts 38 and 40 are such as to engage the collars or shoulders 16 and 18 of the rods 10 and 12 to retain the housing in a desired position encircling the coupling 14. The collars 40, when the housing 20 is closed, also form a support for the device 20 on a conventional pump rod elevator 41, for example. Accordingly, when the housing 22 is in the closed position, shown in FIGS. 1 through 3, it completely encloses or encircles the coupling 14 to substantially retain the same within the housing even if the coupling 14 should fracture violently.

Referring further to FIG. 1, the housing members 24 and 26 are each provided with opposed, spaced apart, transversely projecting, generally cylindrical bosses 48 which are each adapted to journal an impact blow-delivering member generally designated by the numeral 50. Each of the members 50 includes a shank portion 51 slidably disposed for limited movement in a bore 49 formed in the boss 48. Each shank portion 51 includes an elongated slot 52 formed therein. A suitable retainer screw 54 is threadedly engaged with the boss 48 and projects into the slot 52 for loosely retaining the impact-blow delivering members 50 in their respective bosses 48. The members 50 also include transverse impact-blow delivering surfaces 58 formed on the distal end of the shank portions 51 and which are engageable with the exterior surface of the coupling 14, as illustrated in FIG. 1. Each of the members 50 also has an enlarged diameter anvil portion 60 adapted to be struck by a hammer or other impact energy-delivering device, not shown, for transmission of impact blows to the coupling 14 in the vicinity of the threaded portions of the coupling and the threaded connection of the coupling to the rods 10 and 12, respectively. The impact blow-delivering members 50 are supported on the resepective housing members 24 and 26 in such a way that, when the housing 22 is in its closed position, as illustrated, the members 50 are opposed to each other and spaced apart axially with respect to the longitudinal central axis of the housing 20. Accordingly, the members 50 are operable to deliver impact blows to the coupling 14 in the vicinity of the threaded connections between the coupling and the respective pump rods 10 and 12. The slot 52 is positioned such that when the surface 58 of each member 50 is abutted against the coupling there is little or no travel or slack to allow the member 50 to rebound away from the coupling when struck by a hammer or the like.

The housing 22 is retained in its closed position of the respective members 24 and 26 by a unique latch mechanism which will now be described in conjunction with FIGS. 2 and 3. The housing member 24 has two spaced-apart latch hook members 66 which project from the outer surface of the housing member 24, as illustrated. Each of the hook members 66 is provided with a suitable latch bar retaining recess 67, as shown in FIG. 2. The housing member 26 also has two spaced apart bosses 70 having suitable bores which journal opposed trunnions 72 of a latch handle 74. The latch handle 74 is suitably connected to a body part 76 from which the opposed trunnions 72 project and are journalled for pivotal movement of the body part with respect to the bosses 70.

The distal ends of the trunnions 72 have eccentric bearing pins 73 projecting therefrom and each engaged with suitable, somewhat L-shaped latch bar link members 80, as illustrated. The link members 80 are each connected to a somewhat U-shaped latch bar 82 which is engageable with the latch hook members 66, as illustrated. The latch bar 82 has opposed leg portions 83 and 84 which are suitably connected to the link members 80 by adjusting and retaining nuts 86 and 88, respectively. Accordingly, when the latch handle 74 is moved from the position shown in FIGS. 2 and 3 in a generally clockwise direction, viewing FIG. 2, the eccentric pins 73 will travel "over-center" and loosen the engaging force between the latch bar 82 and the hook members 66 so that the bar 82 may be moved out of the recesses 67 and the housing members 24 and 26 swung to open positions to remove them from the coupling 14.

Conversely, when it is desired to secure the device 20 on a coupling 14, as illustrated in the drawings, the housing members 24 and 26 are moved to a position somewhat encircling the coupling 14 and then moved to a closed position whereupon the latch bar 82 is engaged with the hook members 66 and the handle 74 is moved in a counter clockwise direction, viewing FIG. 2, until the pins 73 move to the position shown to go from a released position to a somewhat over-center position to operate in the manner of a toggle mechanism. The closing force for securing the housing members 24 and 26 in the closed position shown may be adjusted by adjusting the positions of the nuts 86 and 88 with respect to the latching bar leg parts 83 and 84 so that, in the closed position of the latching mechanism, the housing members 24 and 26 are snugly secured in abutting relationship to each other and totally encircling the coupling 14. In this condition, the impact blow delivering members 50 may be struck with a suitable hammer or the like, not shown, to deliver impact blows from the surfaces 58 directly to the coupling 14. In this way, the vibrations imposed on the coupling 14 will be transmitted to the threaded connections between the coupling and the respective rods 10 and 12 to aid in loosening such connections. At least some of the impact blow energy will result in heating of the coupling 14 to aid in loosening the threaded connections due to differential thermal expansion of the coupling 14 with respect to the threaded portions 11 and 13 of the rods 10 and 12.

The device 20 may be constructed using conventional materials used for breakout wrenches and similar devices in the mining and oil and gas industries. The members may all be made of alloy steel or similar metals capable of withstanding impact blows and the like. Nominal dimensional tolerances are all that is required between the respective moving parts of the device 20.

Although a preferred embodiment of a rod coupling breakout device in accordance with the present invention has been described in detail herein, those skilled in the art will recognize that various substitutions and modifications may be made to the device without departing from the scope and spirit of the invention as recited in the appended claims.

What is claimed is:

1. A device for delivering impact blows to a coupling interconnecting end-to-end coupled pump rod members and the like, said device comprising:

a housing forming a cavity for receiving said coupling and substantially encircling said coupling; and at least one impact blow delivering member supported on said housing and operable to transmit impact blows to said coupling adjacent a threaded connection between said coupling and a rod member for loosening said rod member and for containing said coupling within said housing during breakout of said rod member from said coupling.

2. The device set forth in claim 1 wherein:

said device includes spaced apart opposed impact blow delivering members supported on said housing and operable to deliver impact blows to said coupling at spaced apart points thereon for loosening threaded connections between said coupling and end-to-end connected rod members.

3. The device set forth in claim 1 wherein:

said impact blow delivering member is slidably supported on a boss formed on said housing for limited movement to engage said coupling when said housing is disposed around said coupling.

4. The device set forth in claim 1 including:

opposed collar parts disposed on said housing and engageable with said rod members for retaining said device encircling said coupling.

5. The device set forth in claim 1 wherein:

said housing comprises two opposed housing members which are connected to each other and moveable from an open position whereby said housing may be disposed around said coupling to a closed position whereby said housing substantially encircles said coupling.

6. The device set forth in claim 5 wherein:

said housing members, when disposed in a closed position, define a bore which is only slightly larger than the diameter of said coupling.

7. The device set forth in claim 5 wherein:

said housing members each include hinge bosses formed thereon whereby said housing members may be hinged to each other for movement between open and closed positions.

8. The device set forth in claim 5 including:

a latch mechanism for securing said housing members in a closed position encircling said coupling, said latch mechanism including a latch hook on one of said housing members and a latch bar engageable with said hook, said latch bar being operably connected to a latch handle supported on the other of said housing members for movement between a position wherein said latch bar may be disengaged from said latch hook to a position wherein said latch bar forcibly engages said latch hook and retains said housing members in a closed position substantially encircling said coupling.

9. The device set forth in claim 8 wherein:

said latch handle includes opposed trunnion members supported on spaced apart bosses on said other housing member, said trunnion members being operably connected to eccentric bearing pin means and said bearing pin means being operably connected to said latch bar.

10. The device set forth in claim 9 including:

at least one link interconnecting said eccentric pin and said latch bar and means for adjusting the position of said latch bar with respect to said link to adjust the closing force of said latch mechanism exerted on said housing members.

11. A device for delivering impact blows to a coupling interconnecting end-to-end coupled pump rods and the like, said device comprising:

a housing forming a cavity for receiving said coupling and substantially encircling said coupling; and spaced apart opposed impact blow delivering members supported on said housing and operable to transmit impact blows to said coupling adjacent respective threaded connections between said coupling and rod members for loosening said rod members and for containing said coupling within said housing during breakout of said members from said coupling, each of said impact blow delivering members being slidably supported on a boss formed on said housing for limited movement to engage said coupling when said housing is disposed around said coupling.

12. A device for delivering impact blows to a coupling interconnecting end-to-end coupled pump rod members and the like, said device comprising:

a housing comprising two opposed housing members connected to each other and moveable from an open position whereby said housing may be disposed around and removed from said coupling to a closed position forming a cavity whereby said housing substantially encircles said coupling;

opposed collar parts disposed on said housing and engageable with said rod members for retaining said device encircling said coupling; and at least one impact blow delivering member supported on said housing and operable to transmit impact blows to said coupling adjacent a threaded connection between said coupling and a rod member for loosening said rod member and for containing said coupling within said housing during breakout of said rod from said coupling.

* * * * *